US005504503A

United States Patent [19]

Clark

[11] Patent Number: 5,504,503

[45] Date of Patent: Apr. 2, 1996

[54] HIGH SPEED SIGNAL CONVERSION METHOD AND DEVICE

[75] Inventor: Iain Clark, Newark, Calif.

[73] Assignee: LSI Logic Corporation, Milpitas, Calif.

[21] Appl. No.: 161,729

[22] Filed: Dec. 3, 1993

[51] Int. Cl.[6] ..... G09G 1/02

[52] U.S. Cl. ..... 345/185; 345/200

[58] Field of Search ..... 365/230.04, 230.05, 365/230.08, 230.09, 189.05; 345/185, 189, 186, 190, 200; 395/164, 165, 166

[56] References Cited

U.S. PATENT DOCUMENTS

| | | | |
|---|---|---|---|
| 4,503,429 | 3/1985 | Schreiber | 345/190 |
| 4,742,350 | 5/1988 | Ko et al. | 345/200 |
| 4,791,580 | 12/1988 | Sherrill et al. | 345/186 |
| 4,845,631 | 7/1989 | Bottorf | 345/190 |
| 4,849,937 | 7/1989 | Yoshimoto | 345/201 |
| 4,894,653 | 1/1990 | Frankenbach | 345/189 |
| 4,905,189 | 2/1990 | Brunolli | 364/900 |
| 4,992,961 | 2/1991 | Peterson | 345/190 |
| 5,097,256 | 3/1992 | Eldridge et al. | 345/191 |
| 5,163,024 | 11/1992 | Heilveil et al. | 345/190 |
| 5,204,664 | 4/1993 | Hamakawa | 345/154 |
| 5,220,312 | 6/1993 | Lumelsky et al. | 345/189 |
| 5,269,003 | 12/1993 | Roskowski et al. | 395/166 |
| 5,276,803 | 1/1994 | Iwase | 395/163 |
| 5,283,866 | 2/1994 | Kumagai | 395/164 |

*Primary Examiner*—Richard Hjerpe
*Assistant Examiner*—Doom Chow
*Attorney, Agent, or Firm*—Poms, Smith, Lande & Rose

[57] ABSTRACT

A random access memory has an access time which is longer than the period of read input signals, for example digital video data signals, such that it cannot respond directly to the input signals. The memory has two read address inputs and two outputs which are arranged as separate channels, each of which can access any location in the memory. The access time of the memory is shorter than two input signal periods. The input signals are applied alternatingly to the read address inputs, and output signals constituted by data stored at addresses corresponding to the input signals are produced at the memory outputs by an arrangement of clocked latches such that, although two input signal periods are used for accessing each memory location, the alternating accessing using two channels enables the memory to produce output signals having the same period (at the same frequency) as the input signals. Additional elements are provided to enable writing to the memory using the alternating channel arrangement, and also to enable memory locations to be unconditionally interrogated while responding to a stream of read input signals.

17 Claims, 4 Drawing Sheets

1
2
3
4
5
6
7
8
72
46, 50
48, 52
54
DATA
READ
56
54
58
60
(READ)

HIGH SPEED SIGNAL CONVERSION METHOD AND DEVICE

BACKGROUND OF THE INVENTION

1. Field of the Invention

The present invention relates to a method and apparatus for converting an input signal to an output signal at a high rate of speed, and, more particularly, to a method and apparatus for accessing values in a memory device at high rates of speed.

2. Description of Related Art

In the field of information processing it is highly desirable to convert or transform a signal from one form to another at a high rate of speed. A signal is often represented by a stream of data and arrives at an input to the information processing system. Each datum in the stream often arrives at the input at a fixed time period after the preceding datum has arrived. The shorter the period is between incoming data, the higher the rate is of the data stream.

The data stream can also be considered as a time sequence of values arriving at the input to the information processing device. When a stream of incoming data arrives at an input to an information processing system at a high rate, it is often advantageous to convert or transform that data to an output at an equally high rate. Usually, at least one output stream of data is desired at a rate substantially equal to the input rate.

One example of a system wherein high conversion rates are desired is in a colorenhancement system for conventional video displays. The image on the video display is composed of many points known as pixels. Each pixel is displayed according to data indicating its position on the display screen and the color to be displayed at that position. The image is composed by updating the display screen frequently using data provided for each pixel. Color-enhancement usually is accomplished by expanding the number of bits used to designate color data for each pixel.

In many conventional video display systems, pixel color data is composed of 8-bits of digital information, which allow for the potential to display 256 different colors at that pixel position. In order to enhance the quality of the displayed image, a practice has developed of expanding, in a conversion or transformation, the number of pixel color data bits, to, for example, 18 or 24 bits per pixel. Although such a practice results in an enhanced color image, difficulties and limitations are encountered in its implementation.

A significant limitation is that the conversion device requires a relatively long amount of time to effect a conversion, or, in this case, a bit-length expansion. This has required the makers of color enhancement systems to limit the rate of the incoming color pixel data stream to accommodate a slow conversion device. Slowing down the data stream means that the pixel information in the video display cannot be sent to the display screen as frequently, thereby limiting the image quality.

One of the most commonly used types of conversion devices is a Random Access Memory (RAM). In a RAM, data values are stored in a number of locations commonly referred to as addresses. Each address or location holds one data value. An input signal to the RAM, commonly referred to as an address signal, indicates which data value will be made available by the RAM on its output line as an output signal. The RAM effects a conversion by accepting an address input value, pointing to or selecting a stored data value in a memory location based on the address input value, and by outputting the data value stored in the selected memory location. The time it takes for the RAM to convert an address input to a valid data signal value is usually referred to as an access time.

Returning to the video display example, one color-enhancement scheme makes use of a RAM with an 8-bit address input capable of addressing or pointing to 256 ($2^8$) separate memory locations. The RAM can be built to store and output data values having virtually any bit-length, such as 18 or 24 bits. By storing appropriate data values in each memory location, the RAM is capable of converting 8-bits of input data to, for example, 18 or 24 bits of output data. Ordinarily, a conventional video display is configured to accept 8-bits of incoming color data per pixel in a data stream. The video display can be reconfigured to accept an expanded number of bits, such as 18 or 24, in an incoming data stream. A RAM is interposed between the video display and the incoming 8-bit data stream so that the incoming 8-bit data stream becomes an address input to the RAM. The address input is used to access an appropriate expanded value, stored in a memory location or address, and to use that value as output to the video display.

Hence, the video display accepts more color information per pixel, increasing the image quality of the displayed image. However, the period between incoming data values in the data stream must not exceed the access time of the RAM, or erroneous conversions will occur, scrambling the image. In other words, the rate of incoming data must be decreased to accommodate the RAM access time to maintain image integrity. This limits the quality of the image capable of being displayed by the video display.

The display of a video image is just one example of an information processing application which requires a conversion of a signal from one form to another at a high rate of speed. Many other situations are encountered where a conversion device, such as a RAM, requires a conversion time which exceeds the potential period between incoming data in a data stream, so that accurate conversion is not possible without slowing down the incoming data stream. A common solution in such situations has been to slow down the data stream to accommodate a slow conversion device.

Various references discuss the rate of image generation in a video display device. However, the general problem of having to accommodate a relatively slow access device has not been adequately resolved by these references.

For example, U.S. Pat. No. 4,905,189, issued to Brunolli, discloses a system for synchronously reading information from a RAM device on a fast port independently of the devices ability to asynchronously read or write information to the RAM on a slow port. Information is read out of the memory and evaluated using two alternatingly switched channels to increase the evaluation speed.

This reference does not effectively address the problem of converting values in an incoming data stream at a relatively high rate using a conversion device having a high conversion or access time, utilizing external timing control elements. It merely teaches how to increase the evaluation speed of data after it has been read out of the device.

Another example, U.S. Pat. No. 4,742,350, issued to Ko et al., discloses a system for displaying an image using picture data, attribute data, and synchronization data, wherein the attribute data includes embedded synchronization data.

U.S. Pat. No. 4,791,589, issued to Sherrill et al., discloses multiple color map memories to quickly store color map information during display line retrace intervals. This primarily involves a scheme for quickly writing data into multiple color map RAM memories, included in a display processor, from a video RAM (VRAM) memory.

U.S. Pat. No. 5,163,024, issued to Heilveil et al., discloses a video memory device employing a bit-mapped RAM unit, a serial shift register and appropriate decode circuitry to enable a single video memory to be used with displays using various numbers of bit resolution.

Although teaching the principles of data storage and retrieval in a random access memory, the prior art, as represented by these references, does not effectively address the problem of converting values in a data stream at a relatively high rate using a conversion device having a high conversion time.

SUMMARY OF THE INVENTION

The present invention effectively overcomes the problem discussed above which has remained unsolved in the prior art. More specifically, a device and method of the invention enable a random access memory having an access time which is ordinarily too long to effectively process input data and perform conversions thereon, to accomplish this task.

In accordance with the invention, a random access memory has an access time which is longer than the period of read input signals, for example digital video data signals, such that it cannot respond directly to the input signals. The memory has two read address inputs and two outputs which are arranged as separate channels, each of which can access any location in the memory. The access time of the memory is shorter than two input signal periods.

The input signals are applied alternatingly to the read address inputs, and output signals constituted by data stored at addresses corresponding to the input signals are produced at the memory outputs by an arrangement of clocked latches such that, although two input signal periods are used for accessing each memory location, the alternating accessing using two channels enables the memory to produce output signals having the same period (at the same frequency) as the input signals.

Additional elements are provided to enable writing to the memory using the alternating channel arrangement, and also to enable memory locations to be read by the cpu 12 while color conversion is occurring.

The present invention also comprises a method of converting input values in a time sequence of signal values into a time sequence of output values. The method comprises the steps of temporarily storing a first input value in a time sequence of signal values, temporarily storing a second input value in the time sequence of signal values, initiating conversion of the first stored input value, initiating conversion of the second stored input value before completion of the first conversion, temporarily storing a converted output value of the first input value, temporarily storing a converted output value of the second input value, and selectively coupling to an output the stored converted output values of the first and second input values so as to provide a time sequence of converted output values.

BRIEF DESCRIPTION OF THE DRAWINGS

FIG. 3(*b*) shows a timing diagram of timing signals for effecting a read operation in the present high speed signal conversion device.

DESCRIPTION OF THE PREFERRED EMBODIMENT

Figure 1:
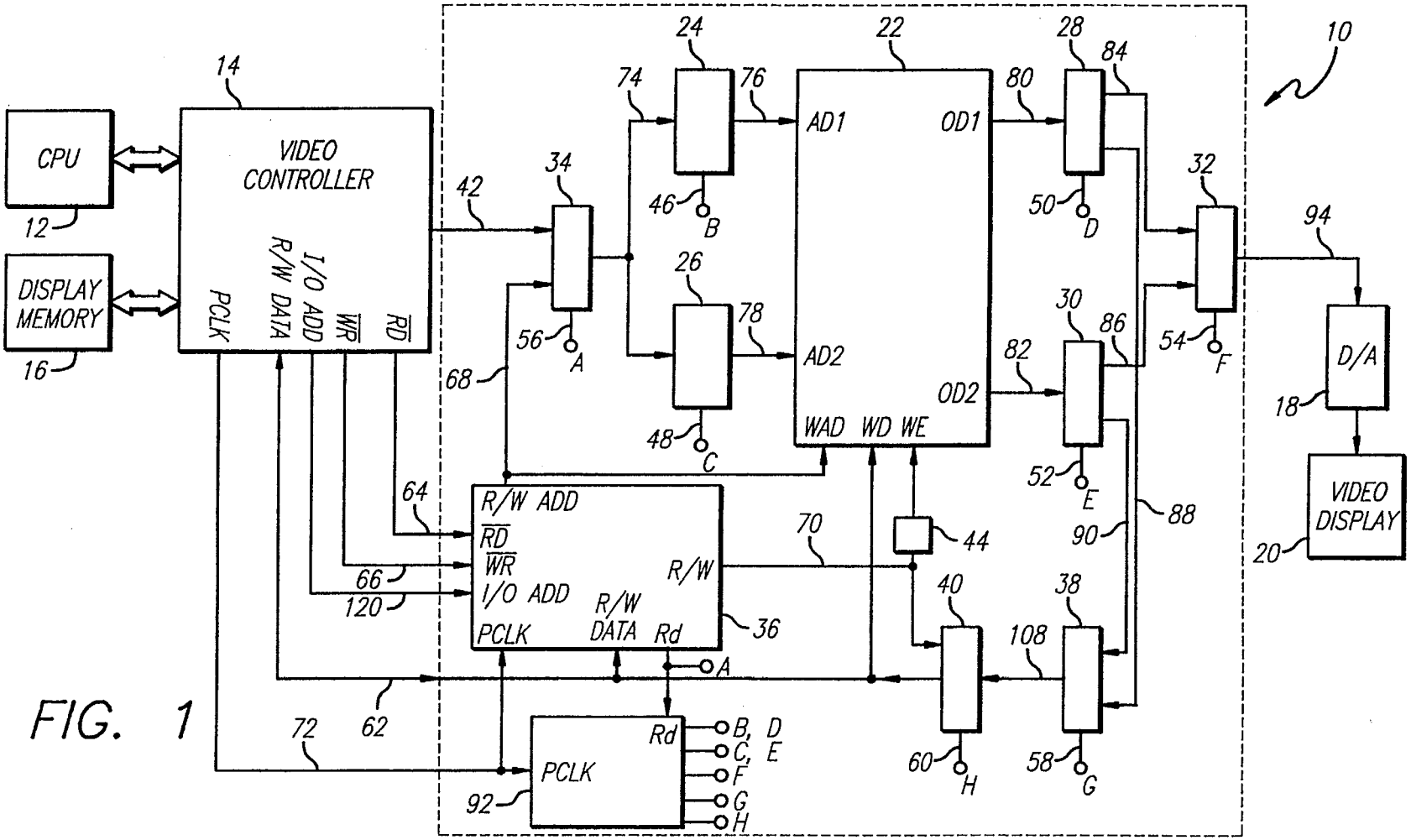
FIG. 1 shows the present high speed signal conversion device in the context of a system for enhancing color in video display image.

Referring to FIG. 1 of the drawings, in one typical operating environment, a high speed signal conversion device 10 in accordance with the present invention can enhance the quality of an image displayed on a conventional video display. The operating environment depicted in FIG. 1 is of a computer controlled video display device, and shows conventional computer or central processing unit (CPU) 12, video controller 14, display memory 16, digital-to-analog conversion device 18, and video display 20, in addition to the present high speed signal conversion device 10.

In conventional fashion, video controller 14 is operatively connected to video RAM 16 and to CPU 12. Digital-to-analog conversion device 18 is operably connected to video display 20, also in conventional fashion. High speed signal conversion device 10 connects between video controller 14 and digital-to-analog conversion device 18, and replaces conventional devices for effecting an expansion of the number of color bits used to provide color information for a pixel in a video display 20.

In the context of this typical environment, high speed signal conversion device 10 accepts an input time sequence of values, or a data stream, typically comprising 8-bit digital values, over color data bus 42 from video controller 14. Each digital value in the data stream comprises 8-bits of color information, or an 8-bit color value, which provides color information for a pixel displayable in an image on the video display 20.

High speed signal conversion device 10 converts 8-bit color values at a substantially high rate, expanding the number of bits available to provide color information to, for example, 18-bits per pixel. By using high speed signal conversion device 10, the frequency of the incoming (and outgoing) time sequence of data values can be increased, for example, from 80 MHz–90 MHz to 160 MHz–170 MHz, when utilizing a memory device 22 with an access time of approximately 4 ns–5 ns, nominal, and approximately 10 ns worst case.

One of ordinary skill in the art will appreciate that the designation, interconnection, and operation of the conventional elements listed above is susceptible to many different forms of implementation, and in no way limits the scope of the present invention. Furthermore, the block diagrams shown in FIG. 1 merely illustrate the functions performed and should not be construed as limiting the possible applications of the present invention to any specific environment. Thus, by way of example, display memory 16 could be either some form of RAM or ROM memory. Similarly, if desired, all of the CPU, video controller, and memory could be embodied in a single circuit. Alternatively, the CPU 12 may be embodied in a single integrated circuit with conventional dynamic random access memory (DRAM)

employed as the display memory 16 thus applicants do not regard their invention as being limited to any specific embodiment of these conventional elements. A detailed discussion of the high speed conversion device 10 of the present invention follows.

Still referring to FIG. 1, one preferred embodiment of the high speed conversion device 10 comprises a memory device 22, first and second input latches 24 and 26, first and second output latches 28 and 30, and a first multiplexer 32. The device 10 can further include a second multiplexer 34, an address module 36, a third multiplexer 38 and a read latch 40. A timing module 92 is also shown.

Memory device 22 preferably is a RAM and includes at least two inputs, or address ports (AD1 and AD2), and at least two outputs, or data ports (OD1 and OD2). The memory device 22 may further include a write address port (WAD), a write data port (WD), and a write enable control (WE). Memory device 22 may, in alternative embodiments, comprise any type of digital storage device, such as, for example, a read only memory (ROM). Memory device 22 contains a plurality of stored digital values which are selectable for output on the data ports based on input values on the address ports.

Memory device 22 is of conventional design such that any and all storage locations (addresses) are addressable on either address port AD1 or AD2, and such that the data stored in any address location may be simultaneously output to either data port OD1 or OD2. The address port AD1 and output OD1 constitute a first memory channel, whereas the address port AD2 and output OD2 constitute a second memory channel.

Thus, inputs to AD1 at a particular time cause a particular stored data value to be output at OD1 at a later time which depends on the access or conversion time of memory device 22. Similarly, inputs to AD2 at a particular time cause a particular stored data value to be output at OD2 at a later time which depends on the access or conversion time of memory device 22. The two input-output channels just described operate independently from each other and can therefore simultaneously access the stored data values.

A preferred example of a two-port RAM memory device which is commercially available as an off-the-shelf item and can be directly utilized as the memory device 22 is the Model IDT7130SA/LA, IDT7140SA/LA, CMOS DUAL-PORT RAMS 8K (1K× 8-BIT), manufactured by Integrated Device Technology Inc., Santa Clara, Calif., as described in a data sheet published in December 1987.

The first and second input latches 24 and 26, as well as first and second output latches 28 and 30, each preferably have at least one input and at least one output, and each respond to a timing pulse at a control input. Respectively, on the occurrence of an appropriate timing pulse, a digital value presented at the latch input is provided at the latch output. Preferably, the input and output latches are conventional edge-triggered flip-flop type devices. Alternatively, the input and output latches may be conventional level sensitive, or transparent, latches.

First (input) multiplexer 34, second (output) multiplexer 32, and third (read) multiplexer 38, are conventional multiplexers each including at least two data inputs, one output, and a select input. Each multiplexer respectively provides a data value at a single input to its output in response to a value, or select pulse, presented to its select input.

Read latch 40 preferably includes at least one input and at least one output, and responds to a timing pulse at a control input. On the occurrence of an appropriate timing pulse, a digital value presented at the latch input is provided at the latch output. Preferably, the read latch 40 is a conventional edge-triggered flip-flop type device. Alternatively, it may be a conventional level-sensitive, or transparent, latch. In an alternative preferred embodiment, the read latch 40 may further include a conventional double-buffered, or multi-stage-buffered, arrangement, so that it may respectively accept and store previous data values and new data values in each stage-buffer. Read latch 40 may also accept as input a byte-select signal, as part of R/W control bus 70, so that a subset of the digital bits stored therein may be selected for output on read/write interface bus 62.

Address module 36 is preferably included in an embodiment of the present high speed conversion device 10. Address module 36 comprises conventional digital circuitry, and includes a read input 64 (RD), a write input 66 (WR), and an input/output address input 120 (I/O ADD) for controlling the read/write mode of operation within the address module 36, a pixel clock timing input (PCLK), and a read/write data input (R/W DATA) for accepting read or write input data from the video controller 14, or, indirectly, from the CPU 12. Address module 36 provides as output a read output (RD), a read/write address output (R/W ADD), and a read/write control output (R/W).

Timing module 92 comprises conventional digital circuitry and preferably includes a pixel clock timing input (PCLK) and preferably includes a read input (RD). Timing module 92 preferably provides phase timing pulse outputs (B/D and C/E) and first select pulse output (F). The timing module 92 can also provide second timing pulse output (H) and second select pulse output (G).

Still referring to FIG. 1, memory device 22 connects at a first address port AD1 to an output of first latch 24 over a first input channel 76. Memory device 22 connects at a second address port AD2 to an output of second input latch 26 over second input channel 78. First and second input channels 76 and 78 preferably comprise 8-bit paths.

Similarly, memory device 22 connects at a first data port OD1 to an input of output latch 28 over first output channel 80 and connects at a second data port OD2 to an input of output latch 30 over second output channel 82. First and second output channels 80 and 82 preferably comprise 18-bit paths.

First input latch 24 and second input latch 26 are respectively connected, at an input, to common input channel 74. Common input channel 74, first input latch 24, and second input latch 26 all preferably comprise 8-bits.

First output latch 28 and second output latch 30 connect at an output to an input of first multiplexer 32 over first and second latched output channels 84 and 86, respectively. Both output latches 28 and 30 and the first multiplexer 32, as well as the latched output channels 84 and 86, preferably comprise 18-bits. The output of first multiplexer 32 is provided on converted output channel 94, which preferably comprises 18bits.

The timing module 92 connects at an input to a clock output of video controller 14 over pixel clock line 72. Timing module 92 also connects at a first phase output (B/D) to a timing pulse input of first input latch 24 over a first phase timing pulse line 46 and to a timing pulse input of first output latch 28 over a first phase timing pulse line 50. Second input latch 26 and second output latch 30 also connect at a respective timing pulse input to a second phase output (C,E) of timing module 92 over second phase timing pulse lines 48 and 52. Finally, timing module 92 connects at a first select output (F) to a select input of first (output) multiplexer 32 over first select pulse line 54.

In operation, the present invention provides for an input signal arriving at a high rate to be converted to an output signal at a same rate, even though a conversion device is used with an access time ordinarily too long (slow) to operate properly at such a high rate. In particular, input signal rates substantially in excess of 160 MHz–170 MHz are achievable when a memory device 22 is used having a nominal access time of approximately 4 nS–5 nS (nanoseconds) and a worst case access time of approximately 10 nanoseconds.

Figure 2:
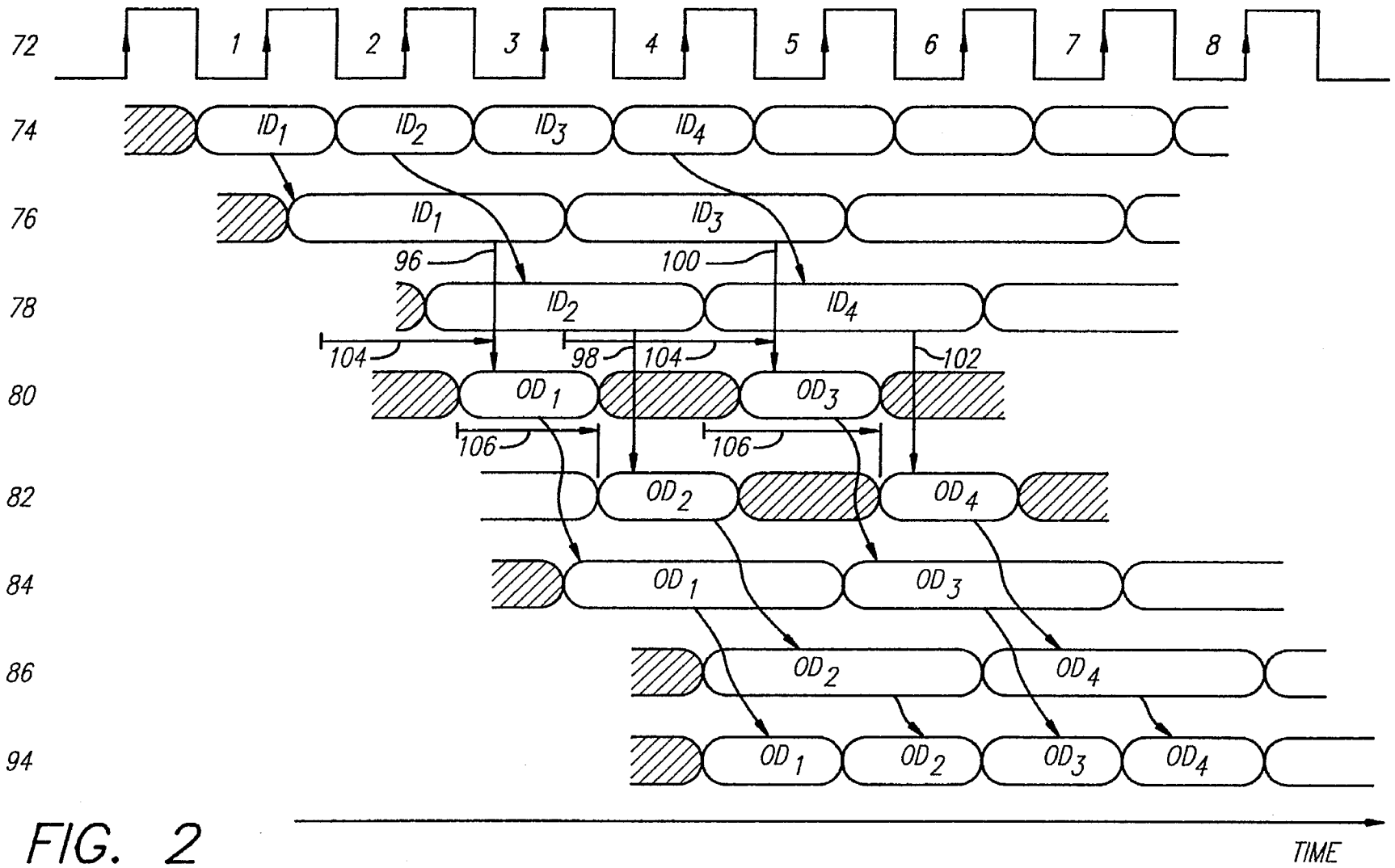
FIG. 2 shows a timing diagram of data flow in the present high speed signal conversion device for converting an input sequence of values to an output sequence of values.

Operation of the invention proceeds with reference to FIGS. 1 and 2. A pixel clock signal, carried on pixel clock line 72, is generated in the video controller 14 and controls the frequency of transmission of pixel information in the overall video display system. In this embodiment a period, or cycle, of the pixel clock preferably begins on each rising edge and concludes on the next rising edge of the pixel clock signal.

Input data values on common input channel 74 arrive in synchronized relationship with the periods of the pixel clock, as shown in FIG. 2. Hence, a time sequence of data values is presented at an input to high speed signal conversion device 10, at a frequency of approximately 160–170 Megahertz.

On a first rising edge of the pixel clock a first data value $ID_1$ is valid on common input channel 74. On a second rising edge of the pixel clock a second data value $ID_2$ is valid on common input channel 74, and so forth as indicated in FIG. 2. Timing module 92 generates, in a conventional manner, a first phase timing pulse and a second phase timing pulse each having a frequency which is one-half the frequency of the pixel clock, respectively shown in FIG. 3 at numerals. 46, 50 and 48, 52.

Also, the first and second phase timing pulses are 180 degrees out of phase with each other. Finally, the timing pulse signals are slightly delayed with respect to the pixel clock so that valid data values are present on common input line 74 whenever a rising edge-transition occurs on the pixel clock, and so that either the first phase signal is high or the second phase signal is high during a given rising edge-transition of the pixel clock. This scheme uses the first and second phase signal levels to enable the first input latch 24 or the second input latch 26 on alternate data values in the incoming data sequence. The first phase timing pulse signal appears on lines 46 and 50, while the second phase timing pulse signal appears on lines 48 and 52. Alternatively, the latches 24 and 26 could be edge triggered by an edge-transition of the first or second phase timing signals, respectively.

First input latch 24 and second input latch 26 each capture, or latch, alternate values from common input line 74 in response to rising edge-transitions of the pixel clock, enabled by a high logic level of either first phase timing pulse line 46 or second phase timing pulse line 48. With reference to FIG. 2, the arrangement of the pixel clock periods and phase timing pulses is such that, during a first period of the pixel clock, a first data value $ID_1$ is latched from common input line 74 into first input latch 24. During a second period of the pixel clock, a second data value ID2 is latched from common input line 74 into second input latch 26. In this fashion, the first and second input latches 24 and 26 alternatingly latch odd and even numbers of data values from the input time sequence of data values.

Once latched, a data value is provided at the outputs of first and second input latches for two cycles of the pixel clock, as shown in FIG. 3. In particular, reference is made to the signal appearing on first input channel 76 and second input channel 78, which prolong the availability of data values $ID_2$ at the address ports AD1 and AD2 of memory device 22.

Memory device 22 has an access or conversion time associated with a data value conversion in each channel. A first channel access or conversion time 104 and a second channel access or conversion time 106 are shown in FIG. 2. The access or conversion time is the time it takes before valid output data appears at a memory device 22 data port OD1 or OD2, after receiving a valid address port input value at AD1 or AD2, respectively.

In FIG. 2, access or conversion operations within memory device 22 are shown by vertical arrows 96, 98, 100, and 102. The access or conversion operations 96, 98, 100, and 102 respectively terminate with a valid output data value $OD_1$, $OD_2$, $OD_3$, and $OD_4$ appearing on first and second output channels 80 and 82 at the conclusion of an access or conversion time 104 or 106. Also, the conversions for odd and even values are timestaggered in the two channels.

From FIG. 2 it can be seen that access or conversion times 104 and 106 both exceed the time of a single pixel clock period. This means that the input time sequence of values is changing at a rate which is faster than a rate at which memory device 22 would ordinarily be able to properly convert the values to valid output data. The latching and timing scheme herein discussed allows for the conversion of values at a rate in excess of the conversion rate in either channel of memory device 22.

Converted output values are latched in a similar manner. First output latch 28 and second output latch 30 each capture, or latch, a value from respective data ports OD1, OD2 of memory device 22 over first output channel 80 and second output channel 82, in response to a rising edge-transition of the pixel clock, in conjunction with the signal levels on first phase timing pulse line 50 and on second phase timing pulse line 52. With reference to FIG. 2, it is seen that output data values are respectively latched into first and second output latches 28 and 30 a fixed number of pixel clock periods (two cycles) after input data values are latched in first and second input latches 24 and 26. In this fashion, the first and second input latches 24 and 26, and the first and second output latches 28 and 30, alternatingly latch odd and even numbers of data values.

Once latched, an output data value is provided at the outputs of first and second output latches 28 and 30 for two cycles of the pixel clock, as shown in FIG. 2. In particular, reference is made to the signal appearing on first latched output channel 84 and second latched output channel 86, which prolong the availability of output data values $OD_1$ at the respective inputs to first multiplexer 32.

Timing module 92 also generates, in conventional fashion, a first select pulse signal which is provided to a select input of first multiplexer 32 on first select pulse line 54. Referring to FIG. 3, the first select pulse signal on select pulse line 54 is preferably generated to be one-half the frequency of the pixel clock and preferably has level transitions in phase with pixel clock transitions.

The application of the first select pulse signal to first multiplexer 32 results in an output time sequence of converted values being provided at converted output channel 94 at the same rate as the incoming input time sequence of data values, despite an access time in memory device 22 which ordinarily would prevent proper conversions at such rates. This is accomplished by responding to read input signals in time alternating relation using the two memory channels.

Summarizing briefly the above operation with reference to FIG. 2, during a first period of the pixel clock, the first input value ($ID_1$) is latched into a first input latch, the first input value ($ID_1$) is presented to memory input at the output of the first latch and memory device 22 begins the process of converting the first input value ($ID_1$) to a first output value ($OD_1$) which requires an access time 104.

During a second period of the pixel clock, the second value ($ID_2$) is latched into a second input latch, the first input value ($ID_1$) continues to be presented to memory input at the output of the first latch, memory device 22 completes the process of converting the first input value ($ID_1$) to a first output value ($OD_1$) at the end of access time 104, and memory device 22 begins the process of converting the second input value ($ID_2$) to a second output value ($OD_2$) which requires access time 106.

During a third period of the pixel clock, the third input value ($ID_3$) is latched into the first input latch, the first output value ($OD_1$) is latched into a first output latch, the second input value ($ID_2$) continues to be presented to memory device 22 at an output of the second input latch, memory device 22 completes the process of converting ($ID_2$) to ($OD_2$) at the end of access time 106, memory device 22 begins the process of converting ($ID_3$) to ($OD_3$) requiring access time 104.

During a fourth period of the pixel clock, the fourth input value ($ID_4$) is latched into the second input latch, the second output value ($OD_2$) is latched into a second output latch, the first output value ($OD_1$) is selected and output by first (output) multiplexer 32, memory device 22 completes the process of converting ($ID_3$) to ($OD_3$) at the end of access time 104, memory device 22 begins the process of converting ($ID_4$) to ($OD_4$) requiring access time 106.

During a fifth period (the first in a new cycle of four) the fifth input value (not shown) is latched into the first input latch, the third output value ($OD_3$) is latched into a first output latch, the second output value ($OD_2$) is selected and output by first (output) multiplexer 32, memory device 22 completes the process of converting ($ID_4$) to ($OD_4$) at the end of access time 106, memory device 22 begins the process of transforming a fifth input data value (IDs) (not shown) requiring access time 104 (not shown in sequence). Processing in this manner continues cyclicly while a time sequence of input values is being presented to the high speed signal conversion device 10.

The invention as described above can be expanded to further include a second multiplexer 34, third (read) multiplexer 38, read latch 40 and address module 36, wherein memory device 22 comprises a RAM. This embodiment allows for the writing of stored data values to memory device 22 asynchronously, and for the reading out of stored data values from memory device 22 into video controller 14 upon an appropriate signal indication. Preferably, second multiplexer 34 comprises 8-bits, third multiplexer 38 comprises 18-bits and read latch 40 comprises 18-bits. These elements enable data to be stored or written into the memory device 22, and further provide an alternate mechanism that enables selected memory locations to be interrogated, or read from, while the device 10 is responding to and converting input data.

Referring to FIG. 1, second multiplexer 34 connects at a first input to an output of video controller 14 over color data bus 42 and connects at a second input to the R/W ADD output of address module 36. The output of second multiplexer 34 is provided on common input channel 74. This arrangement allows color data to be selected for conversion by the high speed signal conversion device 10 during a conversion mode of operation.

During a read mode of operation, address information is passed through second multiplexer 34 to common input channel 74, so that it accesses memory device 22 as would any other input value. During a write mode of operation, address information is simply applied, synchronously or asynchronously, to a write address input WAD of the memory device 22. Preferably color data bus 42 and the R/W ADD output of address module 36 comprise 8-bit digital paths.

Second multiplexer 34 connects at a select input to a read output RD of address module 36 over read select pulse line 56, which controls the source of input to common input channel 74.

Address module 36 connects to video controller 14 over RD line 64 and WR line 66. A two bit I/O ADD line 120 also connects the video controller 14 to the address module 36. Read/write interface bus 62 is a bidirectional bus and connects to address module 36 at a read/write data input R/W DATA, to an input/output port of video controller 14, to an output of read latch 40, and to a write data input WD of memory device 22. Preferably, read/write interface bus 62 comprises an 8-bit path which can carry both addresses and data.

Address module 36 includes a R/W control output as input to both read latch 40 and write strobe circuit 44 over read/write control bus 70, which comprises four bits. Two bits of read/write control bus 70 are utilized to select 6-bits of information from the 18-bits stored in memory device 22 or in the read latch 40, to be next transferred over read/write interface bus 62. The other two bits of read/write control bus 70 are utilized to interface the memory device 22 and the read latch 40 to the interface bus 62 in a conventional manner. This arrangement allows for three transfers of 6-bits each to occur over read/write interface bus 62 in order to effect a transfer of 18-bits into memory device 22 or out of read latch 40. However, one skilled in the art would appreciate that read/write interface bus 62 could be expanded to include the same number of bits as the associated data values being written to or read from memory device 22, without impacting the inventive aspects of the present invention.

Third multiplexer 38 connects at a first input to an output of first output latch 28 and connects at a second input to an output of second output latch 30, respectively, over auxiliary latched output channels 88 and 90. Read latch 40 connects at an input to an output of third multiplexer 38, and connects at an output to read/write interface bus 62. The timing module 92 further includes outputs (G) and (H) providing, respectively, a read select signal on read select line 58 and a read latch timing pulse signal on read latch timing pulse line 60.

Address module 36 preferably has two modes of operation, based on input values to its RD input, its WR input, and its I/O ADD inputs, which are invoked in a conventional fashion. A first mode provides for reading a stored data value from memory device 22 from a location first provided over read/write interface bus 62. This mode of operation also provides for incrementing an address counter within address module 36 in order to read a next stored data value from a next location in memory device 22. A second mode of operation provides for writing or storing a data value in memory device 22 at a location first provided to address module 36 over read/write interface bus 62. This mode of operation also provides for incrementing an address counter to write to a next location in memory device 22.

Preferably, read/write interface bus 62, and all ports to which it connects, comprise an 8-bit digital bus. During a write operation to a provided memory location, video controller 14 initiates the operation by sending an appropriate indication on WR line 66 and on I/O ADD lines 120, in conventional fashion. Next, video controller 14 sends an address value to address module 36 over R/W DATA bus 62.

The address module 36 provides this address to the write address port WAD of memory device 22, while also providing an enable indication and a byte-select indication over read/write control bus 70 to write strobe circuit 44. Next, for an 18-bit word length RAM, a first 6-bits of data is provided over read/write interface bus 62 to memory device 22 at its write data port, and is stored in a first write operation to the 6 currently strobed bits of the 18-bit location indicated by the WAD port value. The strobing operation is repeated two more times to fill all 18-bits of the addressed memory location with a stored data value. In write address increment mode, an address counter is incremented to provide the address for the next location to be written, and three 6-bit write operations are performed as described above.

Figure 4:
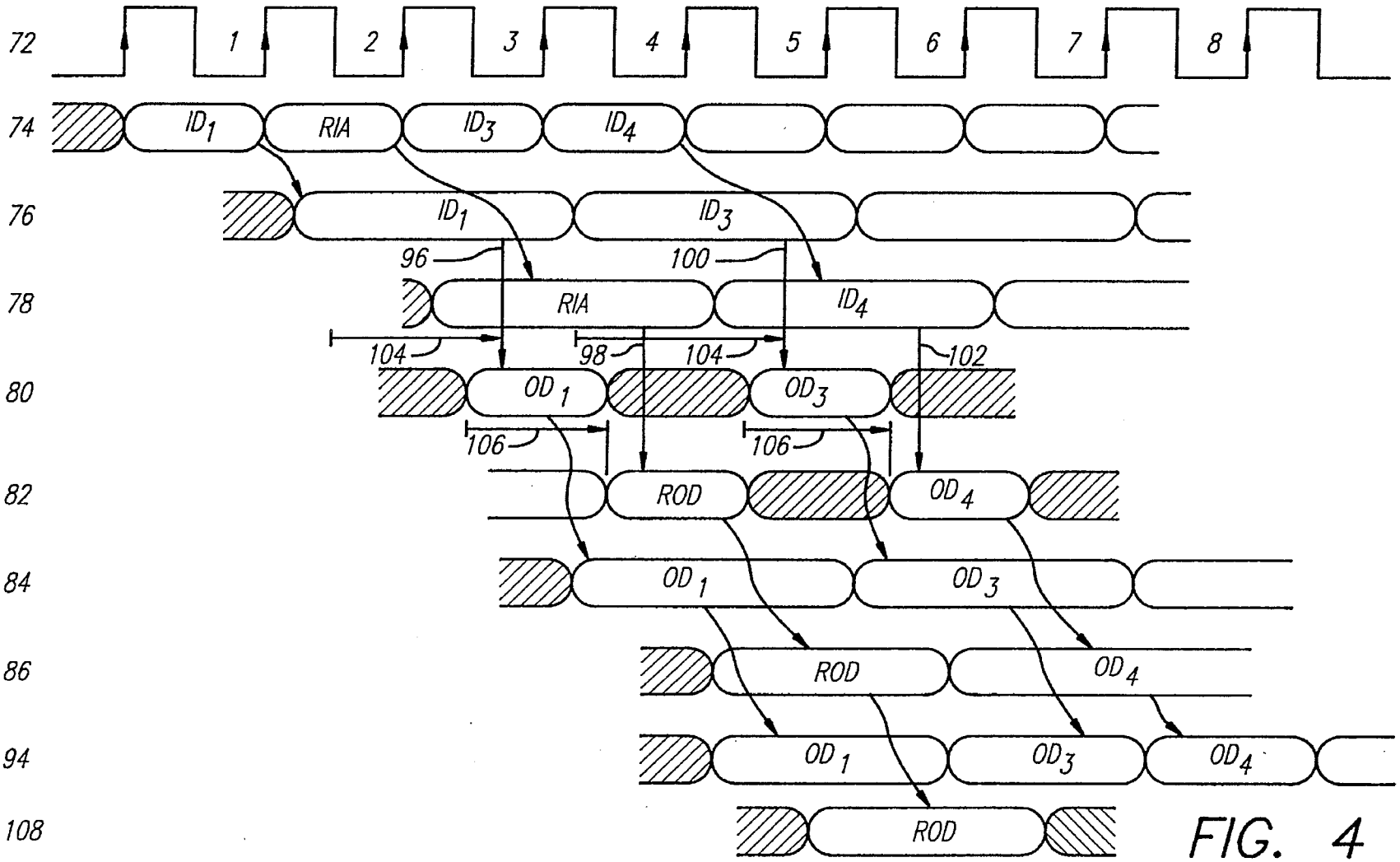
FIG. 4 shows a timing diagram of data flow during a read operation in the present high speed signal conversion device.

In read mode, video controller 14 provides an appropriate indication to address module 36 over WR line 66 and I/O ADD lines 120, in conventional fashion. Referring to FIG. 4, address module 36 applies a read select pulse from its read port RD, synchronized with the pixel clock, to second multiplexer 34 over read select pulse line 56, as well as to the timing module 92. This causes second multiplexer 34 to provide a read address value, obtained from the R/W ADD port of address module 36 over read/write address bus 68, to the common input channel 74.

The read address value is provided to the memory device 22 at an address port just as any other data value would be so provided, however, the converted output value is captured in the read latch 40 rather than being output at converted output channel 94. The value of converted output 94 is held constant at its previous data value for one extra cycle of the pixel clock to avoid outputting spurious color values to any pixels in the image of the video display 20. These operations are performed as follows.

Figures 3A, 3B:
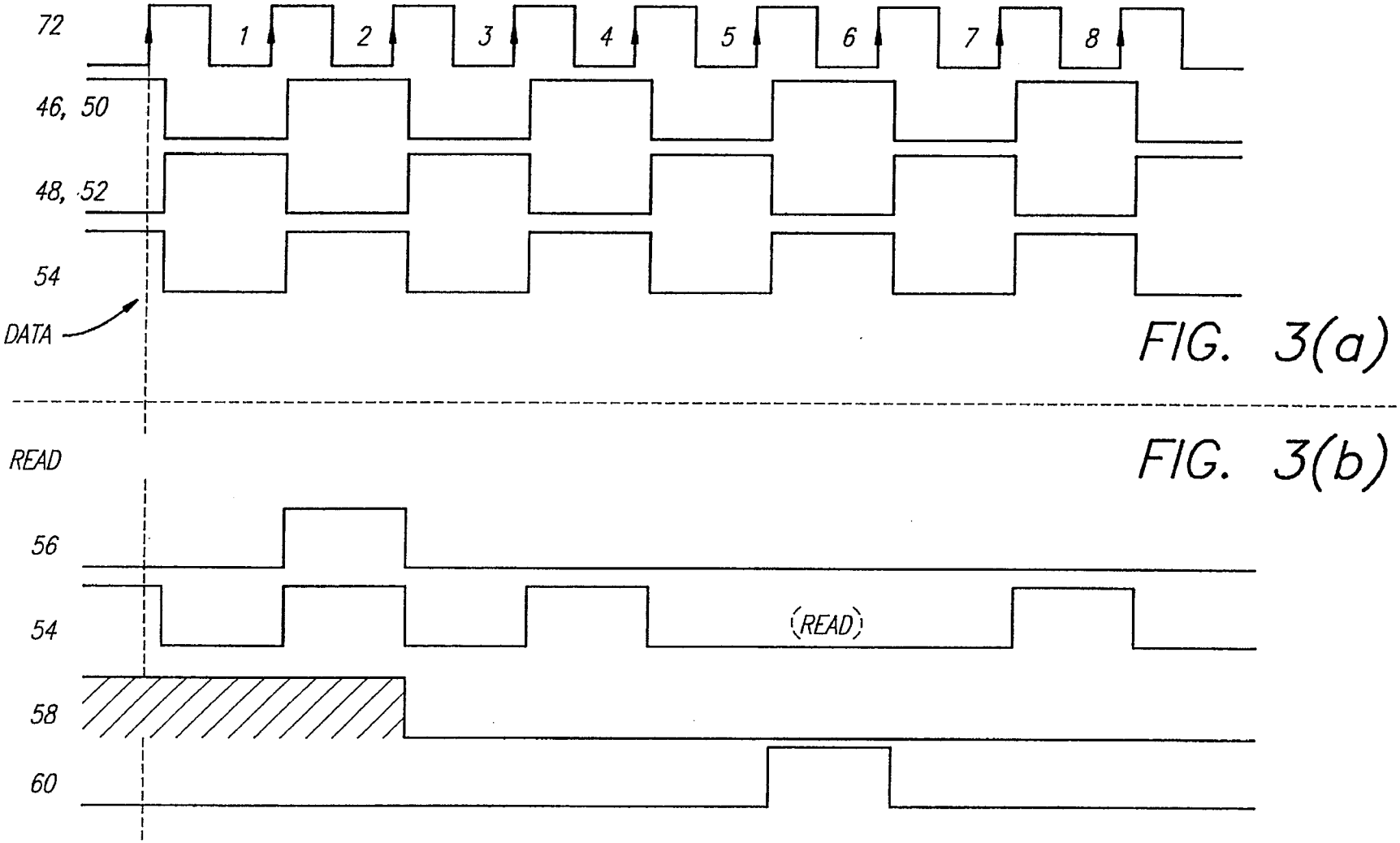
FIG. 3(*a*) shows a timing diagram of timing signals for the present high speed signal conversion device.

Referring to FIG. 3(b), for example, the read select pulse on line 56 may occur substantially in phase with either the first phase timing pulses on lines 46, 50, or the second phase timing pulses on lines 48, 52. Timing module 92 uses conventional circuitry to determine which of the first or second phases is substantially in phase with the read select pulse.

For example, in FIG. 3(*b*) the read select pulse 56 is substantially in phase with the second phase timing pulse 48, 52. Timing module 92 detects this situation and provides for delayed signal outputs onto first select pulse line 54, read select line 58, and read latch timing pulse line 60.

Referring to FIG. 4 it is seen that a read input address RIA replaces the input data value ID2 that would have been captured during that cycle of the pixel clock. The read input address value is then converted in memory device 22 just as any other value would be. However, instead of being presented to converted output line 94 on the sixth succeeding cycle of the pixel clock (as $OD_2$ would have been), the read out data value ROD is selected by the third multiplexer 38 and latched into read latch 40. Meanwhile, the signal on the first select pulse line 54 to first multiplexer 32 is adjusted so that $OD_1$ is prolonged at the converted output channel to avoid spurious color information being provided to a pixel in the image being displayed on video display 20.

The timing relationship for accomplishing the above read operation is depicted generally in FIG. 3(*b*), with respect to the above described example situation. Timing module 92 generates the relevant pulses in a conventional manner. Read select pulse on read select pulse line 56 initiates a read operation, causing a read input address RIA to be input to memory device 22. A read out data value ROD is obtained through a conversion of the read input address RIA in one of the memory device 22 channels.

Timing module 92 internally determines which of first or second channel in memory device 22 is to perform the read based on which of the first and second phase timing pulses is substantially in phase with the read select pulse 56. Four cycles of the pixel clock later, timing module 92 causes first select pulse line 54 to cease toggling during the fifth succeeding cycle. Timing module 92 also causes read select line 58 to level-shift to the value on the second phase line 48, 52 whenever the read select pulse 56 is high and the pixel clock is on a rising edge-transition, as shown in FIG. 3(*b*). Also, the read select pulse 56 is delayed four cycles of the pixel clock and is applied to read latch timing pulse line 60. The delayed read select pulse causes read latch timing pulse line 60 to transition and capture the read out data ROD off of read out channel 108.

Thus, stored data values in the memory device 22 are readable and writable without significantly interrupting the flow of conversion values through memory device 22. Only a single pixel worth of color information is lost (not updated in the image on video display 20) for each read operation, however, a previous pixel color value is maintained and transmitted to the video display. This mitigates the adverse effect that would otherwise result from the display of read out data (color values) in the image. That is, the pixel displayed during a read operation is not random but is a copy of a previous adjacent pixel and therefore not likely to be noticed.

The read operation also proceeds as described above when a read address is provided by incrementing an address counter within the address module 36 instead of providing the address first over read/write interface bus 62.

One of ordinary skill in the art would appreciate that many details of the foregoing discussion are susceptible to change without detracting from the scope or teaching of the present invention. For example, bit-lengths of various components could be altered, different types of memory device 22 may be utilized, access times in said memory device 22 may vary, and components may be implemented in various semiconductor technologies without detracting from the teaching of the present invention. Similarly, numerous other modifications would be apparent to one of ordinary skill in the art given the present disclosure of the invention.

We claim:

1. A device for converting a sequence of signal values, comprising:

a memory having at least two inputs and at least two outputs;

first and second input latches having inputs coupled to receive a first input signal and outputs coupled to respective inputs of said memory;

at least two output latches having inputs coupled to respective memory outputs and being responsive to timing pulses;

a first multiplexer having at least two inputs coupled to respective outputs of said output latches and selectively coupling one of said inputs to said output in response to a select pulse;

wherein values of said signal are alternatingly latched by said input latches, converted in said memory, latched by said output latches and provided at an output of said first multiplexer;

a second multiplexer having at least two inputs coupled to said first input signal and to a second input signal which and having an output coupled to inputs of said input latches, said second multiplexer selectively coupling one of said input signals to said output in response to a second select pulse;

wherein said memory may selectively convert a value from one of said input signals;

a third multiplexer having at least two input coupled to respective outputs of said output latches and selectively coupling one of said inputs to an output in response to a third select pulse;

wherein values are read from said memory and are provided at said output of said third multiplexer;

a read latch having an input coupled to said output of said third multiplexer and responding to a read pulse;

wherein values are read from said memory and are stored in said read latch for subsequent output; and means for unconditionally interrogating said memory while the device is receiving said first input signal by controlling said first multiplexer to repeat coupling the output of one of said output latches which is latching said first input signal to said output while controlling said third multiplexer to couple the output of the other of said output latches which is latching said second input signal to said read latch.

2. The device of claim 1, wherein:

a first of said input latches responds to a first timing pulse; and a second of said input latches responds to a second timing pulse differing from said first timing pulse.

3. The device of claim 1, wherein:

a first of said output latches responds to a first timing pulse; and a second of said output latches responds to a second timing pulse differing from said first timing pulse.

4. The device of claim 1, wherein said select pulse is synchronized with said input latch timing pulses.

5. The device of claim 1, wherein:

a first of said input latches responds to a first timing pulse; and a second of said input latches responds to a second timing pulse 180 degrees out of phase with said first timing pulse.

6. The device of claim 1, wherein said memory further includes a write input for writing values to said memory.

7. The device of claim 1, wherein said memory further comprises at least two parallel memory access channels.

8. The device of claim 1, wherein said memory further includes:

a plurality of storage locations wherein any location is addressable by said memory inputs and wherein the value stored in said storage locations may be provided as output to any of said memory outputs.

9. A device for transforming a sequence of signal values, comprising:

a memory having two inputs and two outputs;

two input latches having outputs coupled to said memory inputs, said input latches being responsive to timing pulses;

two output latches having inputs coupled to said memory outputs and being responsive to timing pulses;

a first multiplexer having at least two inputs coupled to respective outputs of said output latches and selectively coupling one of said inputs to said output in response to a select pulse;

a second multiplexer having two inputs respectively coupled to a first input signal and to a second input signal and having an output coupled to an input of said input latches, said second multiplexer selectively coupling one of said input signals to said output in response to a second select pulse;

wherein a first of said input latches responds to a first timing pulse, a second of said input latches responds to a second timing pulse 180 degrees out of phase with said first timing pulse, and said memory may selectively convert a value from one of said input signals;

a third multiplexer having two inputs respectively coupled to said outputs of said output latches and selectively coupling one of said inputs to an output in response to a third select pulse;

a read latch having an input coupled to said output of said third multiplexer and responding to a read pulse;

wherein values are read from said memory and are stored in said read latch for subsequent output; and means for unconditionally interrogating said memory while the device is receiving said first input signal by controlling said first multiplexer to repeat coupling the output of one of said output latches which is latching said first input signal to said output while controlling said third multiplexer to couple the output of the other of said output latches which is latching said second input signal to said read latch.

10. A random access memory device, comprising:

a random access memory having at least two inputs and at least two outputs;

first and second input latches having inputs coupled to receive a first input signal and outputs coupled to respective inputs of said memory;

at least two output latches having inputs coupled to respective memory outputs and being responsive to timing pulses;

a first multiplexer having at least two inputs coupled to respective outputs of said output latches and selectively coupling one of said inputs to said output in response to a select pulse;

wherein values of said signal are alternatingly latched by said input latches, stored in said memory, latched by said output latches and provided at an output of said first multiplexer;

a second multiplexer having at least two inputs coupled to said first input signal and to a second input signal which and having an output coupled to inputs of said input latches, Said second multiplexer selectively coupling one of said input signals to said output in response to a second select pulse;

wherein said memory may selectively store a value from one of said input signals;

a third multiplexer having at least two inputs coupled to respective outputs of said output latches and selectively coupling one of said inputs to an output in response to a third select pulse;

wherein values are read from said memory and are provided at said output of said third multiplexer;

a read latch having an input coupled to said output of said third multiplexer and responding to a read pulse;

wherein values are read from said memory and are stored in said read latch for subsequent output; and means for unconditionally interrogating said memory while the device is receiving said first input signal by controlling said first multiplexer to repeat coupling the output of one of said output latches which is latching said first input signal to said output while controlling said third multiplexer to couple the output of the other of said output latches which is latching said second input signal to said read latch.

11. The device of claim 10, wherein:

a first of said input latches responds to a first timing pulse; and a second of said input latches responds to a second timing pulse differing from said first timing pulse.

12. The device of claim 10, wherein:

a first of said output latches responds to a first timing pulse; and a second of said output latches responds to a second timing pulse differing from said first timing pulse.

13. The device of claim 10, wherein said select pulse is synchronized with said input latch timing pulses.

14. The device of claim 10, wherein:

a first of said input latches responds to a first timing pulse; and a second of said input latches responds to a second timing pulse 180 degrees out of phase with said first timing pulse.

15. The device of claim 10, wherein said memory further includes a write input for writing values to said memory.

16. The device of claim 10, wherein said memory further comprises at least two parallel memory channels.

17. The device of claim 10, wherein said memory further includes:

a plurality of storage locations wherein any location is addressable by said memory inputs and wherein the value stored in said storage locations may be provided as output to any of said memory outputs.

* * * * *